United States Patent [19]

Feuerman

[11] Patent Number: 4,720,026

[45] Date of Patent: Jan. 19, 1988

[54] SEWING ASSEMBLY

[76] Inventor: Arnold I. Feuerman, 5179 Corners Dr., West Bloomfield, Mich. 48033

[21] Appl. No.: 899,466

[22] Filed: Aug. 22, 1986

[51] Int. Cl.[4] ..... D05B 85/00

[52] U.S. Cl. ..... 223/102; 223/101; 223/99

[58] Field of Search ..... 223/99, 101, 102

[56] References Cited

U.S. PATENT DOCUMENTS

| | | | |
|---|---|---|---|
| 1,260,187 | 3/1918 | Gourley | 223/101 X |
| 1,293,660 | 2/1919 | Armstrong | 223/102 |
| 2,113,994 | 4/1938 | Odom | 223/101 |
| 2,297,714 | 10/1942 | Nesbitt | 223/101 X |
| 3,722,763 | 3/1973 | Heinz | 223/101 |
| 4,102,480 | 7/1978 | O'Beirne-Ranelagh | 223/101 |
| 4,127,222 | 11/1978 | Adams | 223/101 |

FOREIGN PATENT DOCUMENTS

| | | | |
|---|---|---|---|
| 681034 | 9/1939 | Fed. Rep. of Germany | 223/101 |
| 505345 | 12/1954 | Italy | 223/99 |
| 9814 | 7/1915 | United Kingdom | 223/101 |

*Primary Examiner*—Werner H. Schroeder
*Assistant Examiner*—Judith L. Olds
*Attorney, Agent, or Firm*—Krass & Young

[57] ABSTRACT

A sewing assembly including a needle, a loop secured to the trailing end of the needle, and a driver member in the form of a thimble adapted to fit on and over the finger of the user and including a hook portion extending upwardly from the main body portion of the thimble and adapted to be inserted into the seat defined by the crotch defined at the juncture of the forward end of the loop with the trailing end of the needle. The loop thus coacts with the needle to facilitate ready threading of the sewing assembly, to define a seat for receipt of the hook portion of the driving member, and to provide cam surfaces to guide the hook portion into firm seating engagement with the seat at the trailing end of the needle. In an alternate form, the driver member is in the form of a finger ring and the hook portion extends upwardly from the main body of the ring.

6 Claims, 6 Drawing Figures

FIG. 1
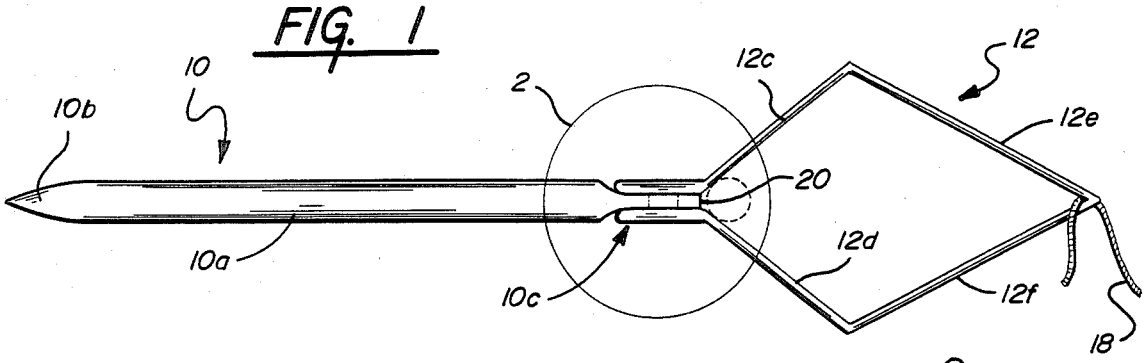
FIG. 2
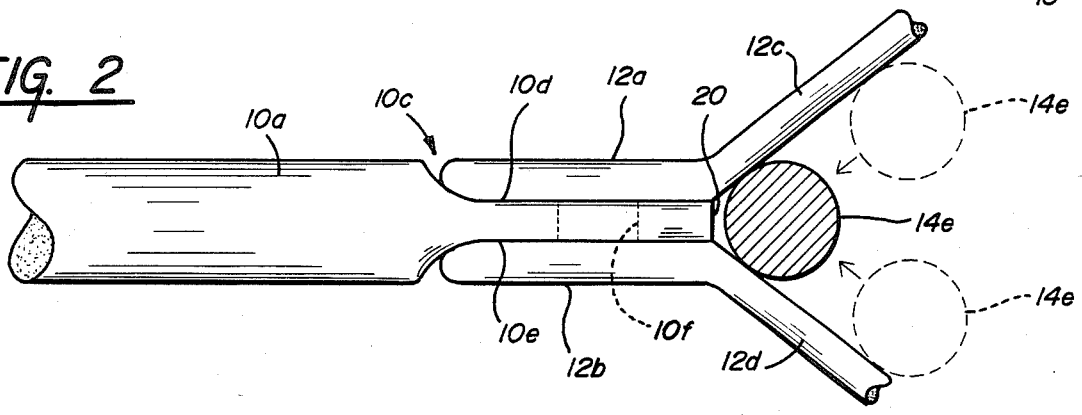
FIG. 3
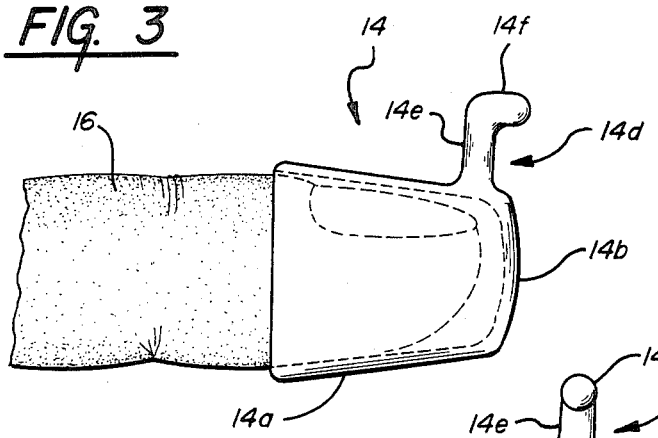
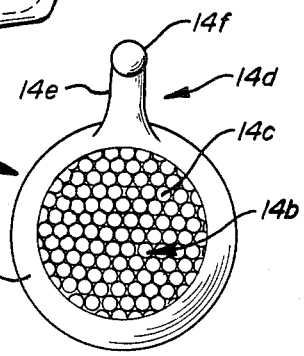
FIG. 4
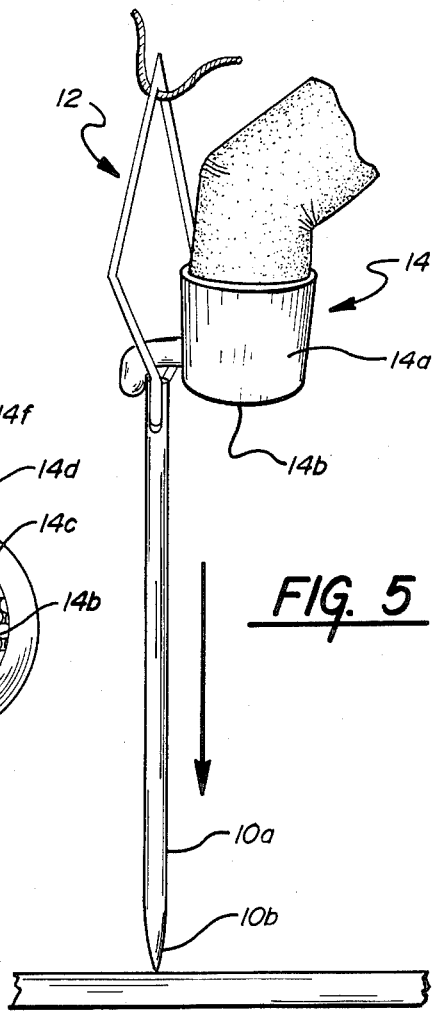
FIG. 5
FIG. 6
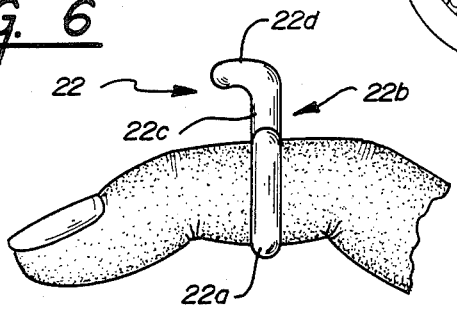

SEWING ASSEMBLY

FIELD OF THE INVENTION

This invention relates to sewing assemblies and more particularly to a sewing assembly especially adapted to facilitate movement of a sewing needle through resistant fabrics.

BACKGROUND OF THE INVENTION

The conventional sewing needle comprises a thin elongated needle body with a point at one end and thread receiving means at the opposite or trailing end so that thread may be secured to the trailing end of the needle and the required sewing operation may be performed by passing the pointed end of the needle through the related fabrics, and/or articles to be attached to the fabrics, and thereafter passing the trailing end of the needle through the fabric to pull the thread through the fabric. Whereas this conventional needle has been used successfully for centuries in many sewing applications, there are applications where the fabric to be pierced by the pointed end of the needle is extremely resistant to such piercing, due either to the extreme thickness of the fabric or the resistant nature of the material of the fabric. In these situations, great difficulty is experienced in passing the needle successively through the fabric with the result that the sewing operation is rendered at best very difficult and at worse impossible.

SUMMARY OF THE INVENTION

This invention is directed to the provision of a sewing assembly in which means are provided to readily assist the needle in its movement through resistant fabrics.

In the sewing assembly according to the invention, the sewing needle defines a seat at a location spaced rearwardly from its pointed front end and a second assembly member is provided which defines a driver sized to engage the seat on the needle and which is operative to exert an axial driving force on the needle to facilitate movement of the pointed end of the needle through a resistant fabric.

According to a further feature of the invention, the second assembly member includes a main body portion sized to fit over the finger of a user and the driver comprises a rod member secured to and projecting outwardly from the main body portion. This arrangement allows the required axial force to be readily applied to the needle by appropriate manipulation of the related finger of the user.

According to a further feature of the invention, the rod member has a hook configuration so as to discourage movement of the rod member out of its seating engagement with the seat on the needle.

According to a further feature of the invention, the main body portion is in the form of a thimble sized to fit on and over the end of the user's finger. This arrangement allows the well known thimble to also serve the function of providing the driving rod member to assist in moving the needle through the resistant fabric.

According to a further feature of the invention, the sewing assembly further includes a loop secured to the trailing end of the needle, and the seat on the needle is defined at the trailing end of the needle at the crotch defined at the juncture of the forward end of the loop with the trailing end of the needle. With this arrangement, the loop facilitates threading of the needle and also provides ramp or guide services for guiding the rod member into engagement with the seat on the trailing end of the needle.

BRIEF DESCRIPTION OF THE DRAWINGS

FIG. 1 is a side view of a needle and loop forming parts of the sewing assembly of the invention;

FIG. 2 is a detailed view on an enlarged scale of the portion of the needle and loop of FIG. 1 seen in the circle 2 of FIG. 1;

FIGS. 3 and 4 are side and end views respectively of a driver member forming a further part of the invention sewing assembly;

FIG. 5 is a schematic view showing the manner in which the invention sewing assembly is employed to drive the needle through a resistant fabric; and FIG. 6 is a view showing an alternative form of driver member.

DETAILED DESCRIPTION OF THE PREFERRED EMBODIMENT

The invention sewing assembly, comprises a needle 10, a loop 12 and a driver member 14.

Needle 10 may be of known form and includes a main body portion 10*a*, a pointed leading end portion 10*b*, and a trailing end portion 10*c*. The trailing end portion 10*c* is necked down in known manner to form flat parallel recessed surfaces 10*d* and 10*e*, and further includes an aperture 10*f* normally employed for receipt of a thread. The needle 10 is preferably formed of a suitable metallic material.

Loop 12 is formed of a suitable resilient metal, such as spring steel, and has a generally diamond shaped configuration. Loop 12 includes parallel attachment end portions 12*a* and 12*b*, short front arm portions 12*c* and 12*d*, and long rear arm portions 12*e* and 12*f*. Front arm portions 12*c* and 12*d* define an acute angle at their juncture with the trailing end of the needle; long rear arm portions 12*e* and 12*f* define an acute angle at their juncture; arm portions 12*c* and 12*e* define an obtuse angle at their junction; and arm portions 12*d* and 12*f* define an obtuse angle at their junction equal to the obtuse angle defined between arm portions 12*c* and 12*e*. The acute angle defined between rear arm portions 12*e* and 12*f*, because of the unequal length of the front and rear arm portions, is less than the acute angle defined between short front arm portions 12*c* and 12*d*. Loop 12 is secured to the trailing end of needle 10 by suitably securing attachment and portions 12*a* and 12*b* respectively to faces 10*d* and 10*e* on the trailing end portion of the needle. For example, portions 12*a* and 12*b* may be secured to faces 10*d* and 10*e* by soldering.

In one embodiment of the invention, seen in FIGS. 3, 4 and 5, driver member 14 is in the form of a thimble member including a cup shaped main body portion 14*a*, including and end wall 14*b* having the usual dimples 14*c*, and a rod portion 14*d* upstanding from the main body thimble portion. Rod portion 14*d* is hook shaped and includes a driver section 14*e*, and a downturned end section 14*f*. As seen in FIG. 3, member 14 is positioned on and over the end of a finger 16 of the user in the usual manner of a thimble. Member 14 is preferably formed of a suitable metallic material and may comprise a standard commercially available thimble with a metallic rod portion 14d suitably secured thereto as by welding or soldering. Alternatively, member 14 may be formed of plastic or the like in a molding operation.

The use of the invention sewing assembly is illustrated in FIGS. 2 and 5. In use, the needle is readily threaded by passing the thread 18 through the wide target presented by loop 12. The asymmetrical construction of the loop increases the acuity of the angle between arm portions 12*e* and 12*f* so that the thread is readily gripped between these arm portions at their juncture to preclude slippage of the thread relative to the loop as the needle is passed successively through the associated fabric in the course of the sewing operation. The asymmetric configuration of the loop also assures that the front arm portions 12*c* and 12*d* will be relatively stiff as compared to the rear arm portions 12*e* and 12*f* to thereby maintain the loop in an open configuration when unstressed.

It will be understood that the loop easily deforms into a collapsed condition under the forces imposed on it by the sides of the fabric being sewn when the needle is drawn through the fabric so as not to harm the fabric. When a fabric is encountered which is resistant to piercing by the pointed end 10*b* of the needle, rod portion 14*d* of driver member 14 is inserted into loop 12 and driver section 14*e* is positioned in the seat 20 defined at the crotch defined at the juncture of loop arm portions 12*c* and 12*d* with the trailing end of the needle. Driver section 14*e* is guided into positive seating engagement with the seat 20 by the camming action imposed by arms 12*c* and 12*d* as the driver section aproaches the seat. After driver section 14*e* has been positioned in seat 20, the finger of the user is manipulated in a sense to pull driver section 14*e* in a direction aligned with the central axis of the needle 10 so that driver section 14*e* exerts an axial driving force on the needle to facilitate movement of the pointed end of the needle through the resistant fabric. In a typical sewing operation, needle 10 is grasped between the thumb and forefinger of the user and the thimble or driver member 14 is worn on the middle finger of the same hand of the user.

FIG. 6 illustrates an alternate form of driver member, indicated by the reference numeral 22, in which the driver member is constituted by a standard finger ring 22*a* to which a rod portion 22*b* is suitably rigidly affixed. Rod portion 22*b* includes a driver section 22*c* and a down-turned end section 22*d*. Ring 22*a* is preferably sized so that the ring seats comfortably on the finger between the first and second joints of the finger, as seen in FIG. 6. The driver member embodiment of FIG. 6 has the advantage that the driver member can be worn on the forefinger of the user where it may readily be brought into play to exert an axial driving force on the needle when a resistant fabric is encountered.

The invention sewing assembly will be seen to provide an inexpensive and simple device for facilitating threading of the needle and for facilitating movement of the needle through resistant fabrics. It will specifically be noted that the loop 12, in combination with the trailing end of the needle, serves several important functions. Specifically, the loop coacts with the trailing end of the needle to define a seat for receipt of the driver section of the driver member; the loop provides cam surfaces to guide the driver section of the driver member into firm seating engagement with the seat; and the loop facilitates the ready threading of the needle. It will further be noted that driver member 14, in thimble form, serves the usual thimble function and also serves to provide the driving means for moving the needle through resistant fabric.

Whereas preferred embodiments of the invention have been illustrated and described in detail it will be apparent that various changes may be made in the disclosed embodiments without departing from the scope or spirit of the invention.

I claim:

1. A sewing assembly comprising:

a first assembly member comprising a sewing needle including an elongated main body portion having a point at its front end and seat means defining a concave rearwardly opening seating surface at a location along said main body portions spaced rearwardly from said front end thereof; and a second assembly member defining a driver member including a main body portion sized to fit over the finger of a user, and a rod portion secured to and projecting outwardly from said main body portion and sized to engage said seat means and operative when pressed forwardly against said seating surface to exert an axial driving force on said needle main body portion to facilitate movement of said pointed end of said needle main body portion through a resistant fabric.

2. A sewing assembly according to claim 1 wherein: said rod portion has a hook configuration.

3. A sewing assembly according to claim 1 wherein:

said main body portion is in the form of a thimble sized to fit on and over the end of the user's finger.

4. A sewing assembly according to claim 1 wherein: said main body portion is in the form of a ring sized to fit over the user's finger.

5. A sewing needle assembly comprising:

a first assembly member comprising an elongated sewing needle, having a point at its front end, and a loop secured to the trailing end of said needle and coacting with said needle to define a seat at the juncture of the front end of said loop with the trailing end of said needle; and a second assembly member defining a driver member sized to engage said seat and operative to exert an axial driving force on said needle to facilitate movement of said pointed end of said needle through a resistant fabric.

6. A sewing needle according to claim 5 wherein:

said loop has a generally diamond configuration with relatively short front arm portions defining a relatively wide angle therebetween adjacent said seat and relatively long rear arm portions defining a relatively narrow angle therebetween to firmly grasp a thread.

* * * * *